US008246784B2

(12) United States Patent
Nilsson et al.

(10) Patent No.: US 8,246,784 B2
(45) **Date of Patent: *Aug. 21, 2012**

(54) PULP MOULD AND USE OF PULP MOULD

(75) Inventors: Björn Nilsson, Kimstad (SE); Lars Graffton, Bettna (SE); Leif Båskman, Norrköping (SE)

(73) Assignee: PAKIT International Trading Company Inc., Upton, St. Michael (BB)

( * ) Notice: Subject to any disclaimer, the term of this patent is extended or adjusted under 35 U.S.C. 154(b) by 0 days.

This patent is subject to a terminal disclaimer.

(21) Appl. No.: 13/053,039

(22) Filed: Mar. 21, 2011

(65) Prior Publication Data

US 2011/0168346 A1 Jul. 14, 2011

Related U.S. Application Data

(63) Continuation of application No. 11/719,816, filed as application No. PCT/SE2005/001771 on Nov. 25, 2005, now Pat. No. 7,909,964.

(30) Foreign Application Priority Data

Nov. 26, 2004 (SE) ..... 0402899

(51) Int. Cl.
*D21J 1/06* (2006.01)

(52) U.S. Cl. ..... 162/226

(58) Field of Classification Search ..... 162/226, 162/218, 376, 382

See application file for complete search history.

(56) References Cited

U.S. PATENT DOCUMENTS

| | | | |
|---|---|---|---|
| 2,903,062 | A | 9/1959 | Lambert |
| 2,981,330 | A | 4/1961 | Wendell |
| 3,250,839 | A | 5/1966 | De Luca |
| 3,284,284 | A | 11/1966 | Wells |
| 3,510,394 | A | 5/1970 | Cadotte |
| 3,624,806 | A | 11/1971 | Lytzen |
| 3,645,320 | A | 2/1972 | Varrati |
| 3,850,793 | A | 11/1974 | Hornbostel et al. |
| 3,870,777 | A | 3/1975 | Jakel |
| 3,932,096 | A | 1/1976 | Kartman |
| 4,125,351 | A | 11/1978 | Alfter et al. |

(Continued)

FOREIGN PATENT DOCUMENTS

| | | |
|---|---|---|
| DE | 3837467 | 5/1990 |

(Continued)

OTHER PUBLICATIONS

Office Action from Australian IP Office dated Dec. 1, 2009. Notification of Reasons for Refusal; Japanese Patent Application No. 2007-542983; Nov. 4, 2010.

*Primary Examiner* — Mark Halpern
(74) *Attorney, Agent, or Firm* — King & Spalding LLP

(57) ABSTRACT

This invention relates to a porous pulp mold comprising sintered particles and a plurality of drainage channels. The pulp mold of the invention can be produced in a fast and cost effective way. The molding surface of the invention comprises small pore openings, to evacuate fluid and prevent fibers from entering the pulp mold. Furthermore the pulp mold of the invention comprises drainage channels improving the drainage capabilities of the pulp mold. The molding surface can be heated to at least 200° C., due to high heat conductivity of the pulp mold and its ability to withstand high temperatures.

18 Claims, 7 Drawing Sheets

U.S. PATENT DOCUMENTS

| | | | | |
|---|---|---|---|---|
| 4,203,936 | A | 5/1980 | Kiwak et al. | |
| 4,272,318 | A | 6/1981 | Walker et al. | |
| 4,683,028 | A | 7/1987 | Waler et al. | |
| 5,338,169 | A | 8/1994 | Buckley | |
| 5,364,258 | A | 11/1994 | Buckley et al. | |
| 5,399,243 | A | 3/1995 | Miyamoto et al. | |
| 5,431,784 | A | 7/1995 | Miyamoto et al. | |
| 5,641,449 | A | 6/1997 | Owens | |
| 6,103,179 | A | 8/2000 | Larsson | |
| 6,249,772 | B1 | 6/2001 | Walker et al. | |
| 6,517,684 | B1 | 2/2003 | Juul | |
| 6,582,562 | B2 | 6/2003 | Gale et al. | |
| 6,605,187 | B1 | 8/2003 | Nonomura et al. | |
| 7,909,964 | B2 * | 3/2011 | Nilsson et al. | 162/226 |
| 2001/0035275 | A1 | 11/2001 | Gale et al. | |

FOREIGN PATENT DOCUMENTS

| | | |
|---|---|---|
| DE | 1162676 | 2/1994 |
| EP | 0562590 | 5/1993 |
| EP | 0559490 | 10/1993 |
| EP | 0719894 | 7/1996 |
| EP | 0731214 | 11/1996 |
| EP | 1197596 | 4/2002 |
| GB | 2074085 | 10/1981 |
| JP | 05-247900 | 2/1993 |
| JP | 07-070997 | 3/1995 |
| JP | 07-0709977 | 3/1995 |
| JP | 9195200 | 7/1997 |
| JP | 10-088500 | 4/1998 |
| JP | 10-195800 | 7/1998 |
| JP | 2002-088699 | 3/2002 |
| JP | 2003-102762 | 4/2003 |
| JP | 2004-131154 | 4/2004 |
| RU | 883017 | 6/1986 |
| WO | WO 9722755 | 6/1997 |
| WO | WO 03/035981 | 1/2003 |

* cited by examiner 100
150
110
140
150
160
161
130
120
300
260A 120
130
260
261
260
250
220

240
230
250
210
200

Fig. 2
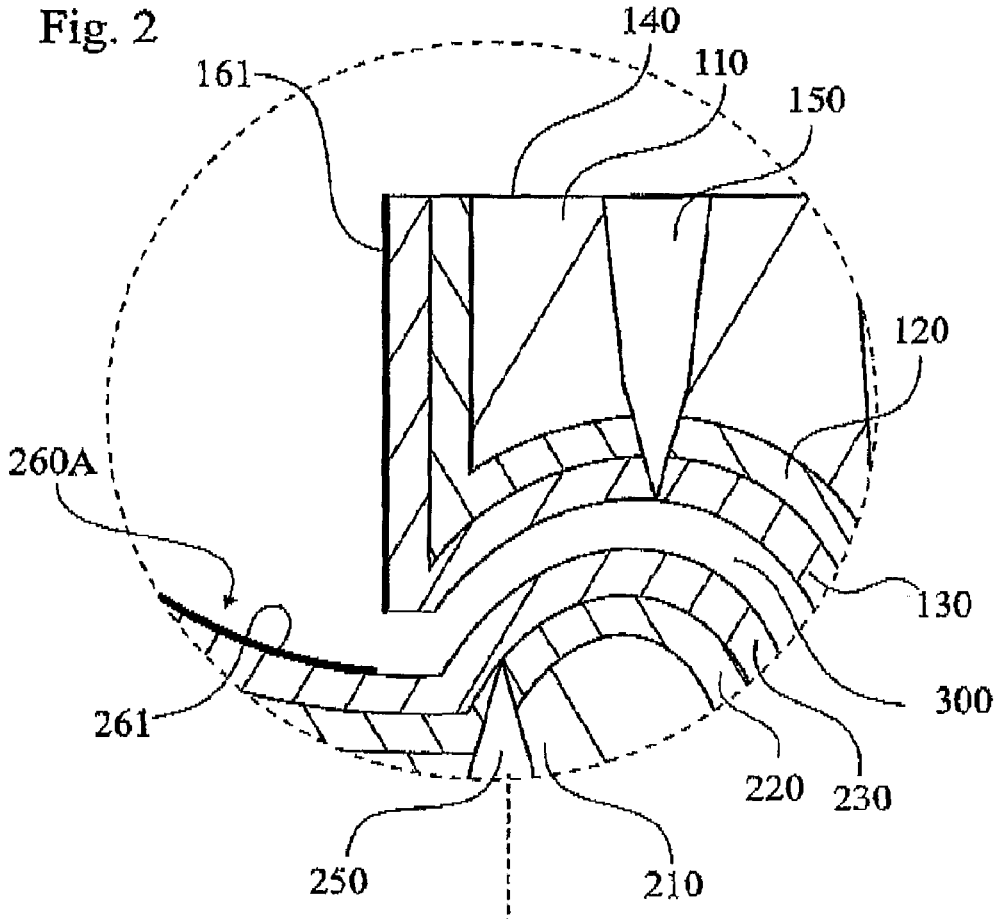
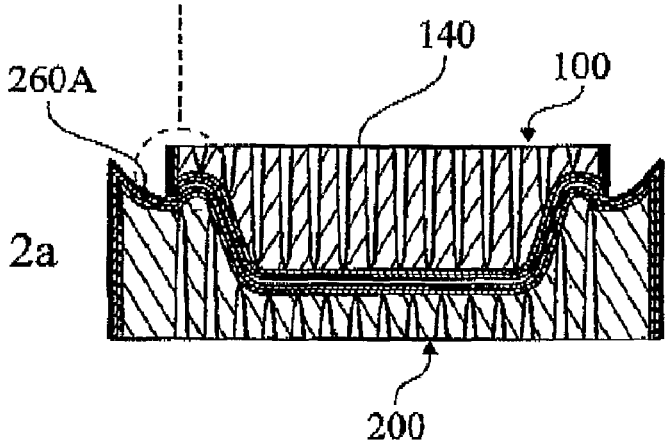
Fig. 2a

Fig. 3
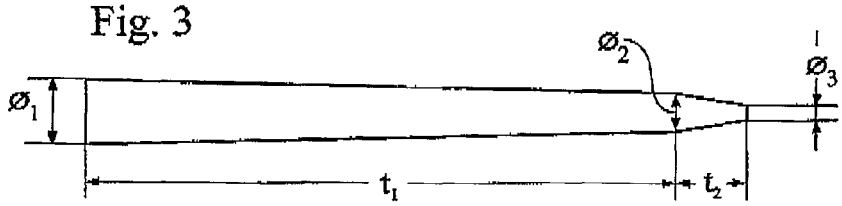
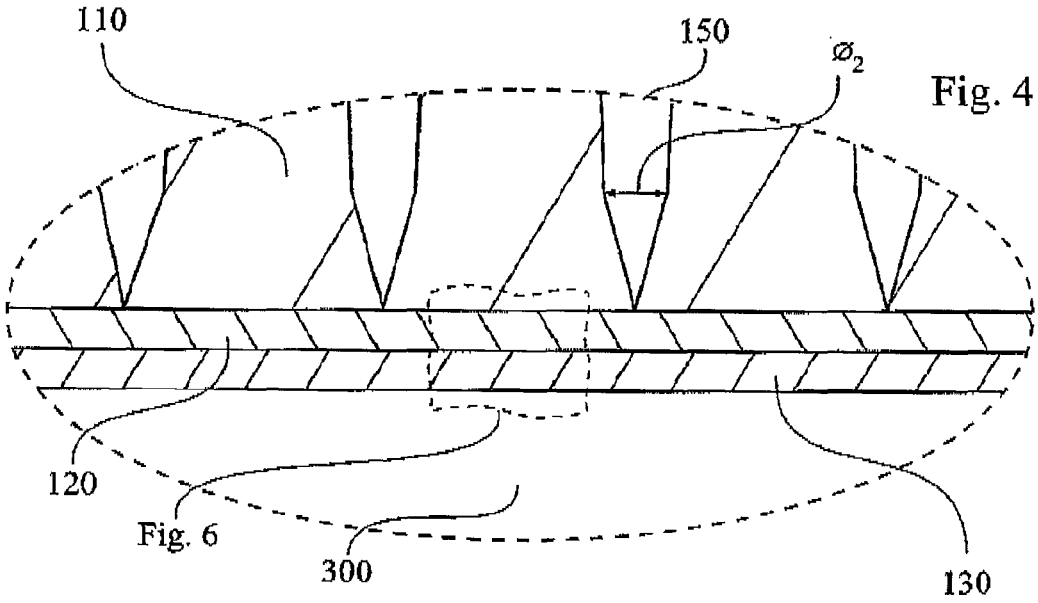
Fig. 4
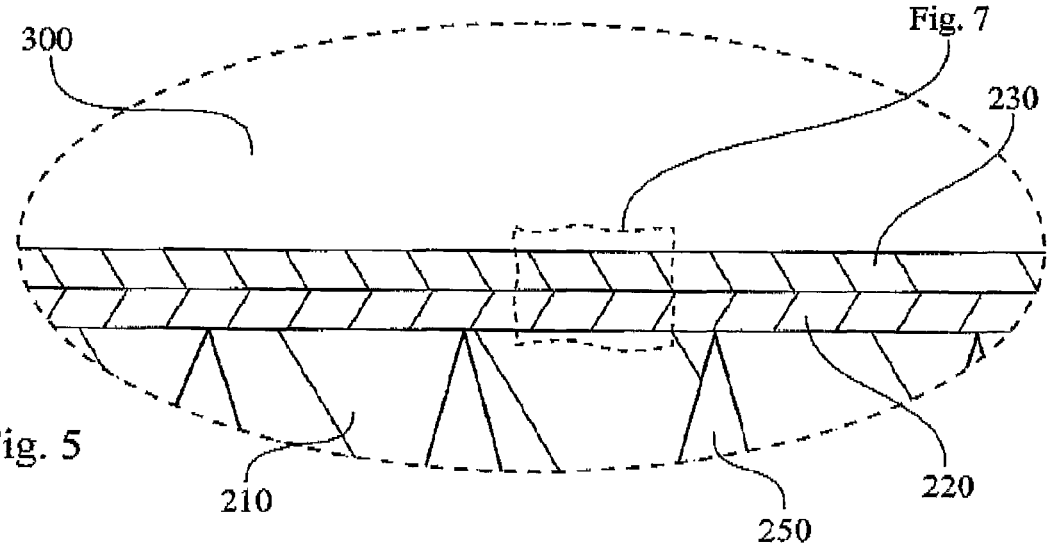
Fig. 5

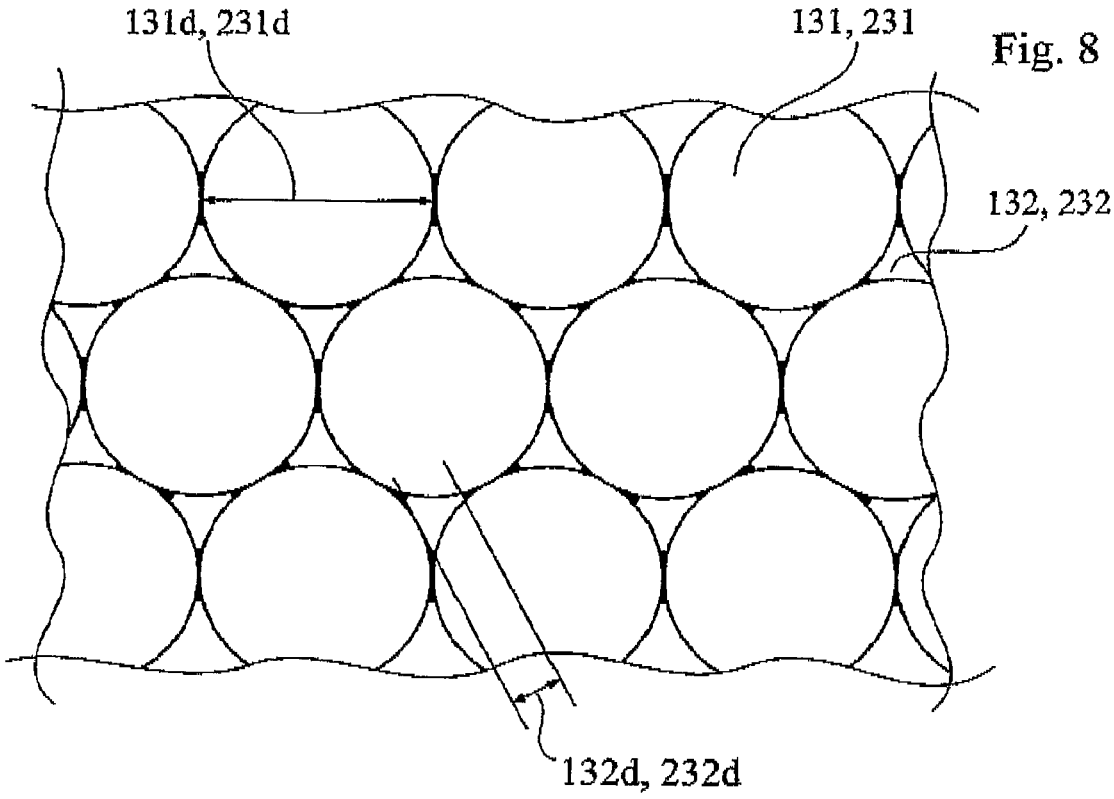
Fig. 8
Fig. 9
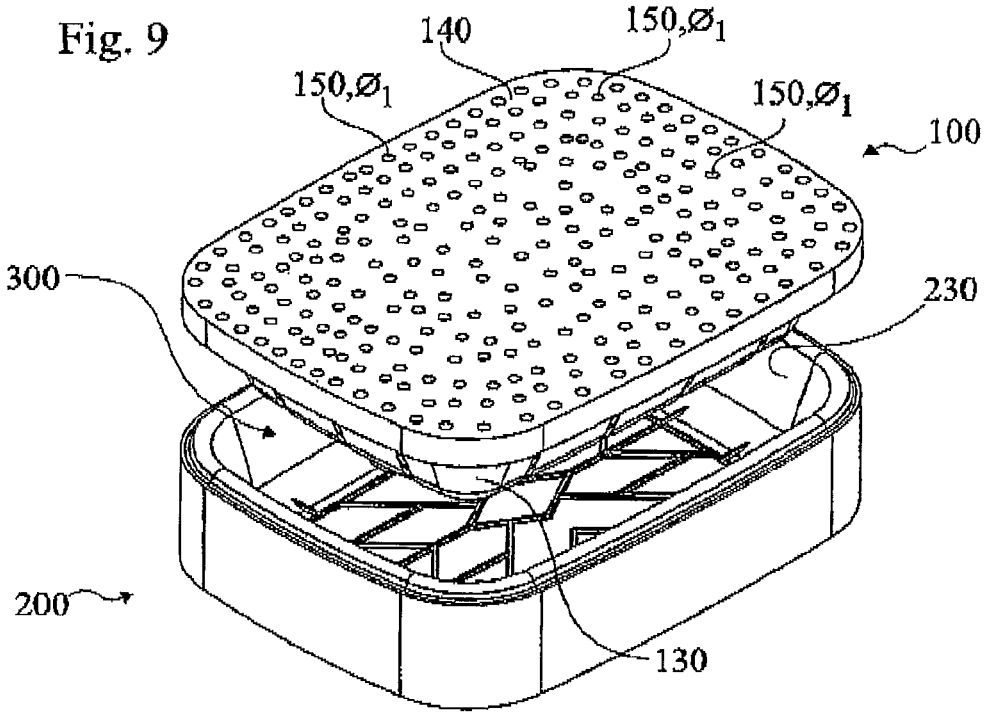

PULP MOULD AND USE OF PULP MOULD

RELATED APPLICATIONS

This application is a continuation of and claims priority to U.S. patent application Ser. No. 11/719,816, filed Jul. 9, 2007, now U.S. Pat. No. 7,909,964 and entitled "Pulp Mould and Use of Pulp Mould," which is a National Stage filing of and claims priority to international application PCT/SE2005/01771, filed on Nov. 25, 2005, which designated the United States and which was published in the English language on Jun. 1, 2006 as WO 2006/057609 A1, and which claims priority to Swedish patent application no. SE 0402899-9, filed Nov. 26, 2004. The entire content of each of the foregoing related applications are hereby fully incorporated herein by reference.

TECHNICAL FIELD

The present invention relates to a pulp mould for moulding three-dimensional pulp objects that can be used in a wide variety of applications. More specifically the objects are formed by using fibre slurry comprising a mixture of mainly fibres and liquid. The fibre slurry is arranged in the mould and part of the liquid is evacuated and a resulting fibrous object is produced.

BACKGROUND OF THE INVENTION

Packagings of moulded pulp are used in a wide variety of fields and provide an environmental friendly packaging solution that is biodegradable. Products from moulded pulp are often used as protective packagings for consumer goods like for instance cellular phones, computer equipment, DVD players as well as other electronic consumer goods and other products that need a packaging protection. Furthermore moulded pulp objects can be used in the food industry as hamburger shells, cups for liquid content, dinner plates etc. Moreover moulded pulp objects can be used to make up structural cores of lightweight sandwich panels or other lightweight load bearing structures. The shape of these products is often complicated and in many cases they have a short expected time presence in the market. Furthermore the production series may be of relative small size, why a low production cost of the pulp mould is an advantage, as also fast and cost effective way of manufacturing a mould. Another aspect is the internal structural strength of the products. Conventional pulp moulded objects have often been limited to packaging materials since they have had a competitive disadvantage in relation to products for example made of plastic. Moreover it would be advantageous to provide a moulded pulp object with a smooth surface structure.

In traditional pulp moulding lines, se for example U.S. Pat. No. 6,210,531, there is a fibre containing slurry which is supplied to a moulding die, e.g. by means of vacuum. The fibres are contained by a wire mesh applied on the moulding surface of the moulding die and some of the water is sucked away through the moulding die commonly by adding a vacuum source at the bottom of the mould. Thereafter the moulding die is gently pressed towards a complementary female part and at the end of the pressing the vacuum in the moulding die can be replaced by a gentle blow of air and at the same time a vacuum is applied at the complementary inversed shape, thereby enforcing a transfer of the moulded pulp object to the complementary female part. In the next step the moulded pulp object is transferred to a conveyor belt that transfers the moulded pulp object into an oven for drying. Before the final drying of the moulded pulp object the solid content (as defined by ISO 287) according to this conventional method is in around 15-20% and afterwards the solid content is increased to 90-95%. Since the solid content is fairly low before entering the oven, the product has a tendency of altering its shape and size due to shrinkage forces and furthermore structural tensions are preserved in the product. And since the shape and size has altered during the drying process it is often necessary to "after press" the product thereby enforcing the preferred shape and size. This however creates distortions and deformations deficiencies in the resulting product. Furthermore the drying process consumes high amounts of energy.

Conventional pulp moulds which are used in the above described process are commonly constructed by using a main body covered by a wire mesh for the moulding surface. The wire mesh prevents fibres to be sucked out through the mould, but letting the water passing out. The main body is traditionally constructed by joining aluminium blocks containing several drilled holes for water passage and thereby achieving the preferred shape. The wire mesh is commonly added to the main body by means of welding. This is however complicated, time consuming and costly. Furthermore the grid from the wire mesh as well as the welding spots is often apparent in the surface structure of the resulting product giving an undesirable roughness in the final product. Furthermore the method of applying the wire mesh sets restrictions of the complexity of shapes for the moulding die making it impossible to form certain configurations in the shape.

In EP0559490 and EP0559491 a pulp moulding die preferably comprising glass beads to form a porous structure is presented, which also mentions that sintered particles can be used. A supporting layer with particles having average sizes between 1-10 mm is covered by a moulding layer with particles having average sizes between 0.2-1.0 mm. The principle behind this known technology is to provide a layer wherein water can be kept by means of capillary attraction and by using the kept water to backwash the moulding die in order to prevent the fibres from clogging the moulding die. This process is however complicated.

U.S. Pat. No. 6,451,235 shows an apparatus and a method for forming pulp moulded objects using two steps. The first steps wet-forms a pre fibrous object which in the second step is heated and pressed under a large pressure. The pulp mould is formed of solid metal having drilled drainage channels to evacuate fluid.

U.S. Pat. No. 5,603,808 presents a pulp mould where one embodiment shows a porous base structure covered by a metal coating comprising squared openings of 0.1 mm to 2.0 mm.

U.S. Pat. No. 6,582,562 discloses a pulp mould capable of withstanding high temperature.

All prior art methods related to the production of a pulp mould, including the above disclosed methods, present some disadvantage.

SUMMARY OF THE INVENTION

It is an object of the invention to provide a pulp mould that eliminates or at least minimizes some of the disadvantages mentioned above. This is achieved by presenting a pulp mould for moulding of objects from fibre pulp, comprising a sintered moulding surface and a permeable base structure where the moulding surface comprises at least one layer of sintered particles with an average diameter within the range 0.01-0.19 mm, preferably in the range 0.05-0.18 mm. This provides the advantage that the outermost layer of the moulding surface has fine structure with small pores in order to produce a pulp moulded object with a smooth surface and to contain fibres between a female and male mould preventing them from entering the same moulds and at the same time allowing fluid or vaporised fluid to emanate.

According to further aspects of the invention:

the pulp mould has a heat conductivity in the range of 1-1000 W/(m° C.), preferably at least 10 W/(m° C.), more preferred at least 40 W/(m° C.), which provide the advantage that heat can be transferred to the moulding surfaces during the press step in order for the press to be realised during increased temperature, which leads to a desirable vaporization of the fluid in pulp material. This vaporization helps the fluid to be sucked out throughout the moulds and helps the pressure to be equally distributed over the moulding surfaces and thus the moulded pulp becomes equally pressurised.

the permeable base structure comprises sintered particles having average diameters that is larger than the particles in the moulding surface, preferably of at least 0.25 mm, preferably at least 0.35 mm, more preferably at least 0.45 mm and having average diameters less than 10 mm, preferably less than 5 mm, more preferred less than 2 mm, which provides the advantages with a base structure having a high fluid permeability to enable fluid and vapour to be evacuated from the moulded pulp and a base structure having a high an internal strength as to withstand the pressure imposed on the base structure during the pressing steps.

a permeable support layer comprising sintered particles is arranged between the base structure and the moulding surface where particles of the support layer have average diameter less than the average diameter of the sintered particles in the base structure and larger than the average diameter of the sintered particles in the moulding surface, which provides the advantages that support layer can minimize voids in the moulds safeguarding that the moulding surface does not collapse into the voids and if the size difference between the sintered particles of the base structure and the sintered particles of the moulding surface is very large, the support layer is added to create a smooth transition from the small particles of the moulding layer to the larger particles of the base structure and thus so by using a particle sizes in between these two extremes, which minimizes voids created between layers of different sizes.

the pulp mould has a total porosity of at least 8%, preferably at least 12%, more preferred at least 15% and that the pulp mould has total porosity of less than 40%, preferably less than 35%, more preferred less than 30%, which provides the advantage that liquid and vaporised liquid can emanate from the pulp mould.

a heat source is arranged to supply heat to the pulp mould, which provides the advantage that the moulding surfaces can be heated during moulding.

the bottom of the pulp mould is substantially flat and free of larger voids, arranged to transmit an applied pressure, which provides a surface suitable for heat transfer and provides the advantage of a form stable pulp mould. With larger voids is meant voids larger than the voids of the drainage channels, described below, for example a relief shaped pulp mould has a large void.

a heat plate is arranged to the bottom of the mould and that the heat plate comprises suction openings, which provides the advantage that heat can be transferred to the pulp mould, thereby heating the moulding surface and that a source of suction can be arranged present a suction at the moulding surface.

the pulp mould has at least one actuator arranged to its bottom, which provides the advantage that a female and a male pulp mould can be pressed together.

the pulp mould is able to withstand temperature of at least 400° C., which provides the advantage that the mould can be heated to at least 400° C. during operation.

the pulp mould contains at least one, preferably a plurality of drainage channels, which provides the advantage that drainage of fluid and vaporised fluid can be increased in the pulp mould.

the drainage channel has a first diameter at the bottom of the pulp mould and a third diameter at the intersection between the base structure and the support layer, which is substantially smaller than the first diameter.

the first diameter is larger than or equal to a second intermediate diameter and that the second diameter is larger than the third diameter.

the second diameter is at least 1 mm, preferably at least 2 mm and that the third diameter is less than 500 μm, preferably less than 50 μm, more preferred less than 25 μm, most preferred less than 15 μm.

the plurality of drainage channels are distributed in a distribution of at least 10 channels/m2, preferably 2500-500000 channels/m2, more preferred less than 40000 channels/m2, providing the advantage of good drainage capabilities.

at least one pulp mould is arranged on the heat plate and that the heat plate has suction openings and that the suction openings are arranged to mate the plurality of drainage channels.

during operation a male and a female pulp mould are pressed into contact and the temperature of the moulding surface is at least 200° C. transmitting heat to a mixture of fibres and liquid arranged between the female and male pulp mould, which provides the advantage that a large part of the liquid is vaporised and due to the expansion of the vapour the vaporised liquid emanates through the porous pulp moulds.

Complex shapes of the mould can be constructed due to the use of sintering technique in manufacturing the moulds. The pulp moulds can be constructed using graphite or stainless steel sintering moulds. These sintering moulds are easily manufactured using conventional methods and can produce very complex shapes at a low cost and short manufacture time.

The sintered mould of the invention can be manufactured with great precision.

The sintered mould of the invention can be used 500000 times with preserved properties.

The pulp mould may comprise one or more non-permeable surface areas containing said the sintered particles, the non-permeable surface area having a permeability that is substantially less than that of the moulding surface.

If the sintered mould is outside the accuracy requirements it can be reformed by pressing the sintered mould in a second mould in which the sintered mould was created, without loss of characteristic features Surface structures on one or both sides of the pulp object can be created. For instance a logotype can be moulded at the bottom of a dinner plate. This can be done by adding a thin sintered layer with the shape of the logotype at one or both mouldings surfaces.

A high internal strength in the resulting pulp moulded object can be produced using the pulp mould of the invention.

Smooth surfaces on both sides are provided due to the fine accurate structure of the mouldings surfaces, combined with an ability to withstand high pressure and due to the heat conductivity making it possible to press using a high temperature at the moulding surfaces, enabling the liquid to be vaporised which will act as a cushion which smoothens any small inaccuracies in the moulding surfaces.

Suction is evenly distributed due to the homogenous porosity of the mould.

Pressure between the moulding surfaces becomes evenly distributed due too the cushion effect of the steam expansion and the evenly suction.

BRIEF DESCRIPTION OF THE DRAWINGS

In the following the invention will be described in relation to the appended figures, wherein:

FIG. 3 shows a single drainage channel, FIG. 8 shows a part of the moulding surface of the female and male pulp mould as seen from the forming space, FIG. 9 shows a three-dimensional drawing of a pulp mould according to the present invention.

DETAILED DESCRIPTION

Figures 1, 4, 5:
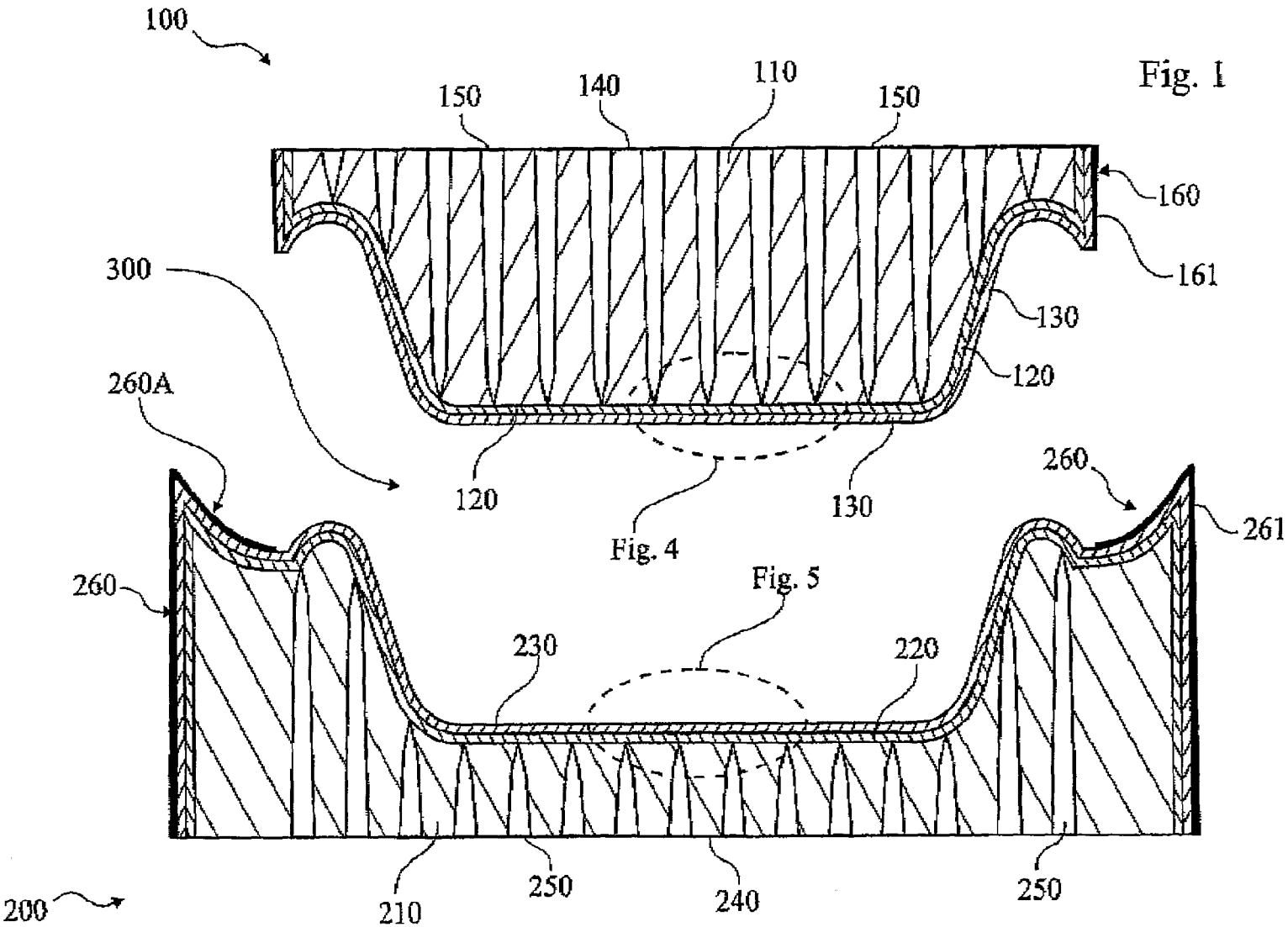
FIG. 1 shows a cross sectional view of a male part and complementary female part of a pulp mould according to a preferred embodiment of the present invention in a separate position.
FIG. 4 is a cross sectional zooming of the male part of the pulp mould of FIG. 1 showing the moulding surface the tips of three drainage channels and the upper part of the base structure.
FIG. 5 is a cross sectional zooming of the female part of the pulp mould of FIG. 2 showing the moulding surface the tips of two drainage channels and the upper part of the base structure.

FIG. 1 shows a cross-sectional view of a male 100 and a complementary female 200 part of a pulp mould according to a preferred embodiment of the present invention. Both the female 200 and the male 100 part are constructed according to the same principles. A forming space 300 is arranged between the pulp moulds 100, 200, where the moulded pulp is formed during operation. A base structure 110, 210 constitutes the main bodies of the pulp mould 100, 200. A support layer 120, 220 is arranged upon the base structure 110, 210. A moulding surface 130, 230 is arranged upon the support layer 120, 220. The moulding surface 130, 230 encloses the forming space 300. A source for heating 410 (see FIG. 10), a source for suction 420 using underpressure and at least one actuator (not shown) to press the female mould 200 and the male mould 100 against each other are arranged at the bottom 140, 240 of the base structure 110, 210. It is advantageous that the pulp moulds 100, 200 have good heat conductive properties in order to transfer heat to the moulding surfaces 130, 230. It is advantageous that the base structure 110, 210 is a stable structure being able to withstand high pressure (both applied pressure via the bottom 140, 240 and pressure caused by steam formation within the mould) without deforming or collapsing and at the same time having throughput properties for liquid and vapour. More specific it is preferred that the throughput properties facilitate the drainage of liquid and vapour from the wet pulp mixture inside the forming space 300 during operation of the pulp mould 100, 200. It is therefore advantageous that the pulp mould has a total porosity of at least 8%, preferably at least 12%, more preferably at least 15% and at the same time to be able to withstand the operating pressure it is advantageous that the total porosity is less than 40%, preferably less than 35%, more preferably less than 30%. The total porosity is defined as the density of a porous structure divided by the density of a homogenous structure of the same volume and material as the porous structure. The throughput properties are increased by a plurality of drainage channels 150, 250. It is preferred that the plurality of drainage channels 150, 250 are frusta conical and having a sharply pointed tip towards the intersection between base structure 110, 210 and support layer 120, 220, e.g. the plurality of drainage channels 150, 250 of the present embodiment has a nail form with the nail tip pointing towards the forming space 300.

As is evident from FIG. 1 all parts of the mould 100, 200 are applied with the fine particles that forms the support layer 130, 230. However, all parts of that surface are not used to form a pulp object, but there are peripheral surfaces 160, 260 that will not be used to form a pulp object. As a consequence, these surfaces 160, 260 preferably have a permeability that is substantially smaller than the moulding surfaces 130, 230. In the preferred embodiment this is achieved by applying a thin impermeable layer 161, 261 having appropriate properties, e.g. any kind of paint having sufficient strength durability to maintain its impermeable function when used under operating conditions (high heat some vibration, pressure, etc.). Alternatively this impermeable layer 161, 261 may be achieved by workshop machining techniques, for instance by applying a high pressure upon these surfaces 160, 260, to achieve a compacted surface layer 160, 260 whereby the pores will be closed. Of course other methods of making these surfaces 160, 260 impermeable can be used as long as the result yields an impermeable surface 160, 260.

Figure 2:
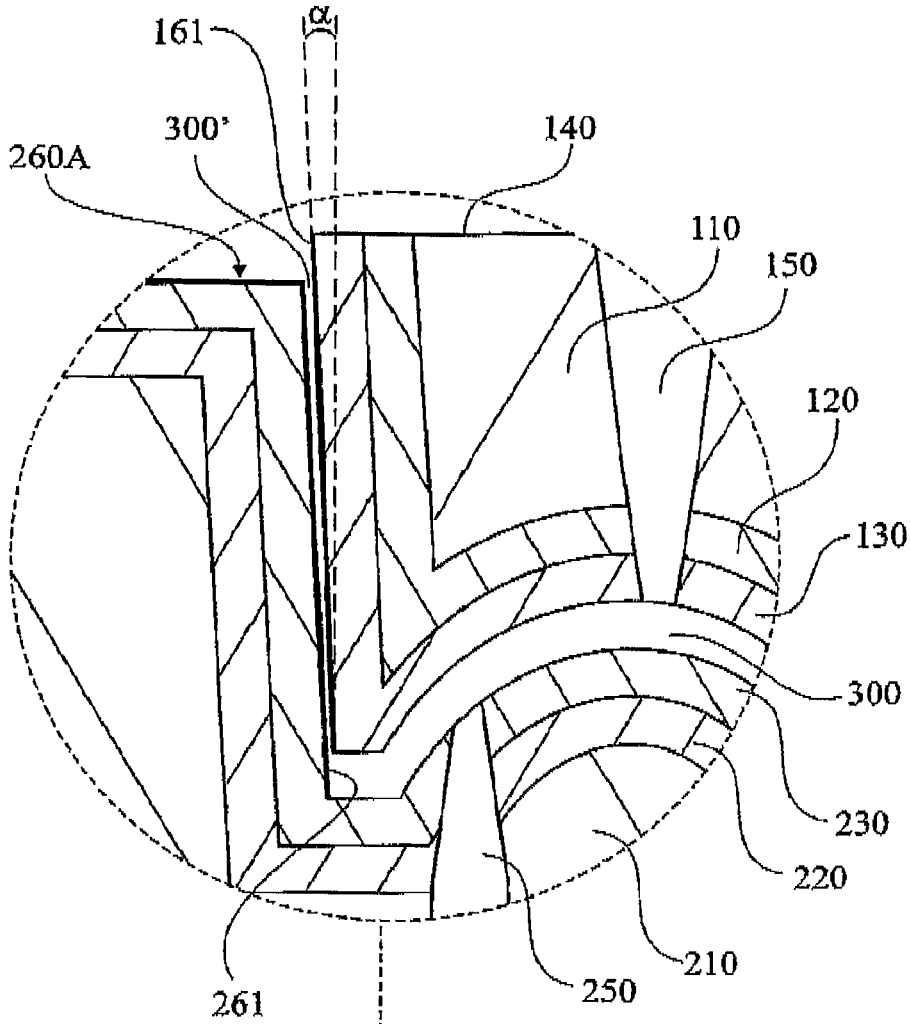
FIG. 2 shows the same as FIG. 1 but in an a moulding position.
Figure 2A:
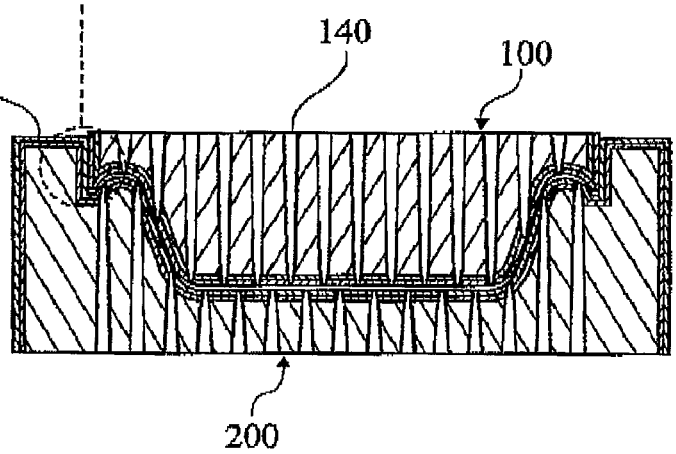
FIG. 2*a* shows a zooming of a part of FIG. 2, FIG. 2' shows a pulp mould in a moulding position according to a second embodiment of the invention, FIG. 2*a'* shows a zooming of a part of FIG. 2'.

In FIG. 2, 2*a* there is shown the position of the two mould halves 100, 200 during the heat press forming action. As can be seen there is formed a forming space 300 between the mould surfaces 130, 230, that is about 0.8-1 mm, preferably in the range 0.5-2 mm. As can be the surfaces that will not be used to form a pulp object, 160, 260A has a thin impermeable layer 161, 261 applied upon them. As can be seen in FIG. 2A the upper drainage channel 150 ends where the moulding surface 130 meets the forming space 300 and the lower drainage channel 250 ends between moulding surface 230 and support layer 220. The drainage channels 150, 250 can have its pointed ending anywhere in the interval from the border between the base structure 110, 210 and the support layer 120, 220 till the border between the moulding surface 130, 230 and the forming space 300.

In this connection it may be mentioned that possible protruding fibre lumps, protruding on top of the slope 260A, may easily also be handled by the use of applying a water stream, e.g. by means of an appropriately formed water jet, that will fold the protruding lumps onto the moulding surface 230 being under vacuum, such that they adhere to the rest of the fibres web.

In FIG. 2', 2*a*' according to a second embodiment of the invention there is shown the position of the two mould halves 100, 200 during the heat press forming action. As can be seen there is formed a forming space 300 between the mould surfaces 130, 230, that is about 1 mm, preferably in the range 0.5-2 mm. As also can be seen from FIG. 2' the mating surfaces 161, 261 of the mould halves 100, 200, do form a substantially smaller gap 300' than the forming space 300. The mating surfaces 161, 261 is somewhat tilted to the left as is shown by the angle $\alpha$ in order to facilitate introduction of the male 100 into the female mould 200. Also it can be seen that the bottom surface 140 of the male mould is above the level of the upper portion 260A of the female mould, i.e. there is formed a gap between the support and heat plate 410 (see FIG. 10) of the male mould 100 and the female mould 200, which is feasible thanks to the arrangement according to the inventive process where the applied pressure may be directly transferred to the pulp body, i.e. by means of the mould surfaces 130, 230. In other words normally there is no need for external abutting means (although they may be useful in some cases) to position the mould halves 100, 200 during the pressing action. According to the embodiment shown in FIG. 2' the design provides for using the relatively sharp edge between the horizontal surface 260A and the vertical surface 261 to cut possible fibres lumps that protrude beyond the moulding surface 130, 160 of the male mould 100. As can be seen in FIG. 2', 2*a*' the plurality of drainage channels 150, 250 is shown to end at the intersection between the moulding surface 130, 230 and the forming space 300. Depending of an actual embodiment of the invention the drainage channels 150, 250 could have its pointed ending anywhere in the interval from the border between the base structure 110, 210 and the support layer 120, 220 till the border between the moulding surface 130, 230 and the forming space 300.

FIG. 3 shows a drainage channel 150, 250. The diameter $Ø_1$ is the diameter of the plurality of drainage channels 150, 250 at the bottom 140, 240 of the pulp moulds 100, 200. The main part 151, 251 of the plurality of drainage channels 150, 250 inclines slightly from the diameter $Ø_1$ towards the diameter $Ø_2$. The relation between diameter $Ø_1$ and diameter $Ø_2$ is at least $Ø_1 \geqq Ø_2$ and preferably $Ø_1 > Ø_2$. Diameter $Ø_2$ is preferably above 2 mm, preferably 3 mm, i.e. preferably large enough to prevent capillary attraction. The form of the main portion $t_1$ of each drainage channel 150, 250 is dependent of the thickness of the pulp mould 100, 200 and therefore varies according to the desired shape of the pulp moulded object. The top portion $t_2$ of each drainage channel 150, 250 has a diameter $Ø_2$ that preferably decreases sharply towards diameter $Ø_3$, at the border between base structure 110, 210 and support layer 120, 220. The diameter $Ø_3$ is preferably substantially zero and at least less than 500 μm preferably less than 50 μm, more preferably less than 25 μm, most preferably less than 15 μm. The relation between diameter $Ø_2$ and diameter $Ø_3$ is preferably $Ø_2 > Ø_3$ and most preferred $Ø_2 >> Ø_3$. In the embodiment of FIG. 1 and FIG. 2, $Ø_2$ was set to 3 mm, $Ø_3$ was set to 10 μm and the length $t_2$ of the top portion was set to 10 mm. If a drainage channel would have its tip in the border between the moulding surface 130, 230 and the forming space 300 and meeting an inclination of the moulding surface 130, 230 above 40° it may be an advantage to use a drainage channel 150, 250 without a conical top, i.e. $Ø_2 = Ø_3$, in order to ensure a pointed opening towards the forming space 300. Another way to ensure a pointed opening towards the forming space 300, when the moulding surface 130, 230 has a steep inclination, is to increase the length $t_2$ of the top portion. If the drainage channels are arranged to have their tips in the border between the moulding surface 130, 230 and the forming space 300, the openings $Ø_3$ of the plurality of drainage channels 150, 250 at the moulding surface 130, 230 are preferably very small in order to prevent fibres contained in the forming space 300 from entering the pulp mould 100, 200, and also to produce a resulting surface structure of the pulp moulded object formed in the forming space 300 to be smooth. One of the reasons for the pointed tip of the plurality of drainage channels 150, 250 is to prevent fluid from flowing back to the pulp moulded object after pressure and vacuum is released, due to the flow resistance created by the narrowing channel. Fibres from cellulose normally has an average length of 1-3 mm and an average diameter between 16-45 μm. Preferably the diameter of the drainage channels 150, 250 increases gradually from the openings $Ø_3$ towards the diameter $Ø_2$ and further to the diameter $Ø_1$ of the drainage channels 150, 250. The plurality of drainage channels 150, 250 of the embodiment of FIG. 1 and FIG. 2 was distributed with a distribution of 10000 channels/$m^2$. Normally the distribution is in the interval of 100-500000 channels/$m^2$ and more preferred in the interval 2500-40000 channels/$m^2$.

FIG. 4 and FIG. 5 are cross sectional zoomings of FIG. 1 and FIG. 2 respectively showing the moulding surface 130, 230, the support layer 120, 220, and the upper portion of the base structure 110, 210. As can be seen each drainage channel 150, 250 penetrates the base structure 110, 210 and has its pointed tip at the intersection between the base structure 110, 210 and the support layer 120, 220. Depending of an actual embodiment of the invention the drainage channels 150, 250 could have its pointed ending anywhere in the interval from the border between the base structure 110, 210 and the support layer 120, 220 till the border between the moulding surface 130, 230 and the forming space 300.

Figure 6:
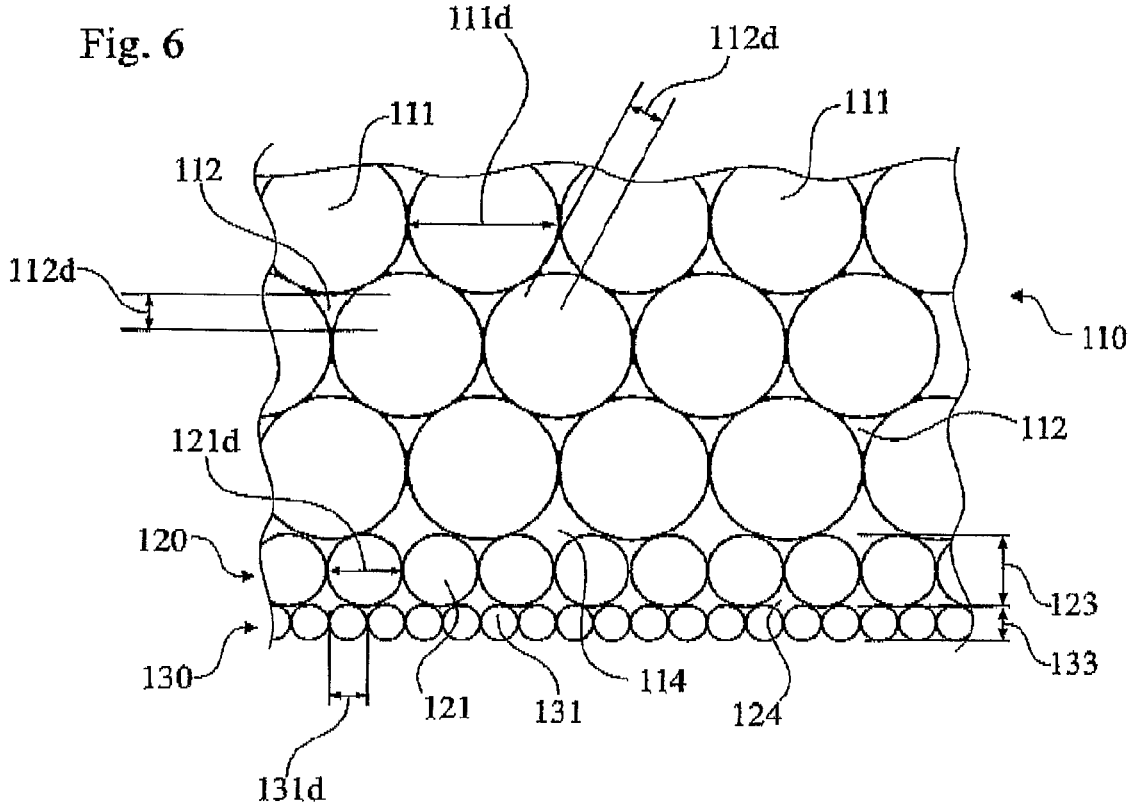
FIG. 6 is a cross sectional zooming of the embodiment shown in FIG. 3 showing the moulding surface and the upper part of the base structure.
Figure 7:
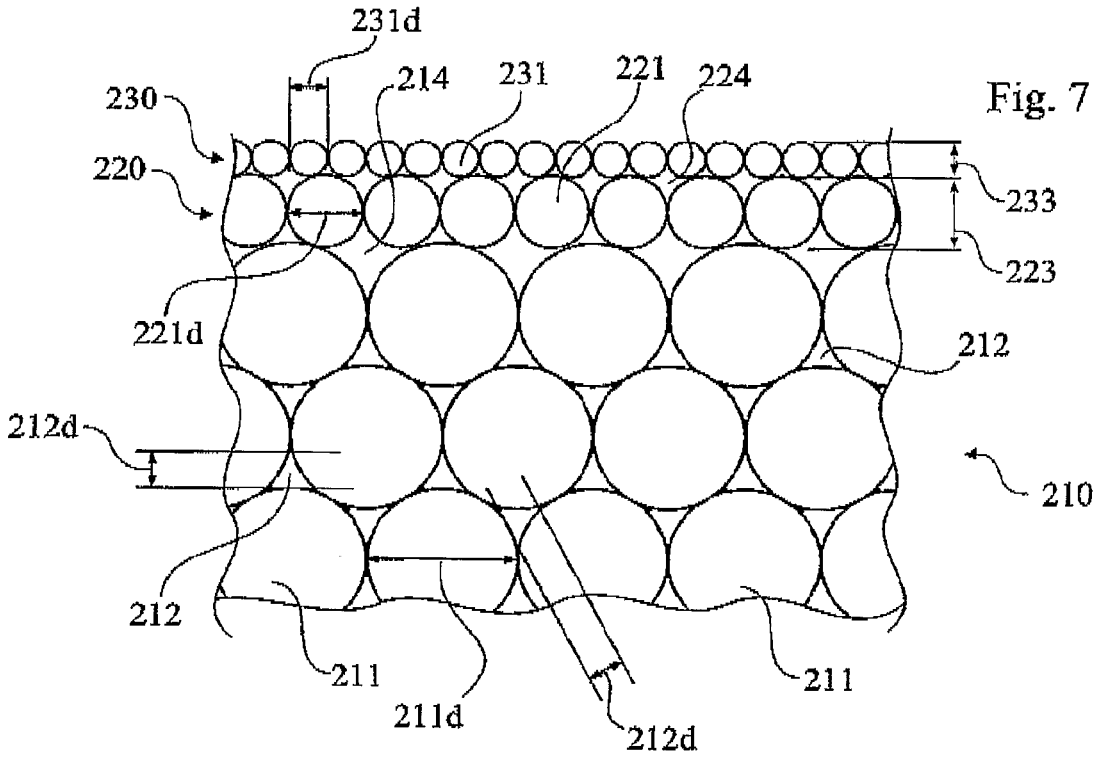
FIG. 7 is a cross sectional zooming of the embodiment shown in FIG. 4 showing the moulding surface and the upper part of the base structure.

FIGS. 6 and 7 are cross sectional zoomings of FIG. 4 respectively FIG. 5 showing the moulding surface 130, 230, the support layer 120, 220 and the upper part of the base structure 110, 210. As can be seen from the figures the moulding surface 130, 230 comprises sintered particles 131, 231, having an average diameter 131*d*, 231*d*, provided in one thin layer. The thickness of the moulding surface is denoted by 133, 233 and in the shown embodiment since the moulding surface 130, 230 comprises one layer of particles the thickness 133, 233 of the moulding surface 130, 230 is equal to the average diameter 131*d*, 231*d*. Preferably sintered metal powder 131, 231 with an average diameter 131*d*, 231*d* between 0.01-0.18 mm is used in the moulding surface 130, 230. (In the shown embodiment sintered metal powder 131, 231 from Callo AB of the type Callo 25 was used to form the moulding surface 130, 230. This metal powder can be obtained from CALLO AB POPPELGATAN 15, 571 39 NÄSSJÖ, SWEDEN.) Callo 25 are spherical metal powder with a particle size range between 0.09-0.18 mm and a theoretical pore size of about 25 μm and a filter threshold of about 15 μm. As is evident for a skilled person in the field of powder metallurgy the particle size ranges includes smaller amounts of particles outside the ranges, i.e. up to 5-10% smaller respectively larger particles, this however has only marginal effects on the filtering process. The chemical composition of Callo 25 is 89% Cu and 11% Sn. As a way of example a sintered structure using Callo 25 and sintered to a density of 5.5 g/$cm^3$ and a porosity of 40 vol-%, would have about the following characteristics; tensile strength 3-4 kp/$mm^2$, elongation 4%, coefficient of heat expansion $18 \cdot 10^{-6}$, specific heat at 293 K is 335 J/(kg·K), maximum operative temperature in neutral atmosphere 400° C. Thus in the shown embodiment the thickness 133, 233 of the moulding surface 130, 230 is in the range 0.09-0.18 mm. Generally the moulding surface 130, 230 comprises sintered particles 131, 231 in at least one layer but most preferred in merely one layer. As can be seen from the figures the support layer 120, 220 comprises sintered particles 121, 221, having an average diameter 121*d*, 221*d*.

The thickness of the support layer is denoted by 123, 223 and in the shown embodiment, since the support layer 120, 220 comprises one layer of particles, the thickness 123, 223 of the support surface 120, 220 is equal to the average diameter 121*d*, 221*d*. (In the shown embodiment sintered metal powder 121, 221 from Callo AB of the type Callo 50 was used to form the support layer 120, 220. This metal powder can be obtained from CALLO AB POPPELGATAN 15, 571 39 NÄSSJÖ, SWEDEN.) Callo 50 are spherical metal powder with a particle size range between 0.18-0.25 mm and a theoretical pore size of about 50 μm and a filter threshold of about 25 μm. The chemical composition of Callo 50 is 89% Cu and 11% Sn. As a way of example a sintered structure using Callo 50 and sintered to a density of 5.5 g/cm$^3$ and a porosity of 40 vol-%, would have about the following characteristics; tensile strength 3-4 kp/mm$^2$, elongation 4%, coefficient of heat expansion $18\cdot10^{-6}$, specific heat at 293 K is 335 J/(kg·K), maximum operative temperature in neutral atmosphere 400° C. Thus in the shown embodiment the thickness 123, 223 of the support layer 120, 220 is in the range 0.18-0.25 mm. The support layer 120, 220 may be omitted, especially if the size difference between the sintered particles 111, 211 of the base structure 110, 210 and the sintered particles 131, 231 of the moulding surface 130, 230, is small enough, i.e. the function of the support layer 120, 220 increase the strength of the mould, i.e. to safeguard that the moulding surface 130, 230 does not collapse into the voids 114, 214, 124, 224. If the size difference between the sintered particles 111, 211 of the base structure 110, 210 and the sintered particles 131, 231 of the moulding surface 130, 230, is very large, the support layer 120, 220 can comprise several layers where the size of the sintered particles 121, 221 gradually is increased in order to improve strength, i.e. to prevent structural collapse due to the voids between the layers.

The base structure 110, 210 of the shown embodiment contains sintered metal powder 111, 211 of the fabricate Callo 200 from the above mentioned Callo AB. Callo 200 is a spherical metal powder with a particle size range between 0.71-1.00 mm and a theoretical pore size of about 200 μm and a filter threshold of about 100 μm. The chemical composition of Callo 200 is 89% Cu and 11% Sn. As a way of example a sintered structure using Callo 200 and sintered to a density of 5.5 g/cm$^3$ and a porosity of 40 vol-%, would have about the following characteristics; tensile strength 3-4 kp/mm$^2$, elongation 4%, coefficient of heat expansion $18\cdot10^{-6}$, specific heat at 293 K is 335 J(kg·K), maximum operative temperature in neutral atmosphere 400° C. The pores 112, 212 of the base structure 110, 210 in the first embodiment has thus a theoretical pore size 112*d*, 212*d* of 200 μm, enabling liquid and vapour to be evacuated through the pore structure.

FIG. 8 shows a part of the moulding surface 130, 230 as seen from the forming space 300. The moulding surface 130, 230 comprises sintered particles 131, 231 having an average diameter of 131*d*, 231*d*. The pores 132, 232 of the moulding surface 130, 230 have a theoretical pore size 132*d*, 232*d*. In the above described embodiment the theoretical pore size 132*d*, 232*d* is about 25 μm. The pores 132, 232 are preferably small enough in order to prevent cellulose fibres from entering the interior of the pulp mould 100, 200, but at the same time enabling liquid and vapour to be evacuated through the pores 132, 232. Fibres from cellulose normally have an average length of 1-3 mm and an average diameter between 16-45 μm.

FIG. 9 shows a three-dimensional drawing of a pulp mould 100, 200 according to the present invention. The bottom opening $Ø_1$ of the plurality of drainage channels 150 of the male mould 100 are shown in the drawing. A source for heating, a source for suction using underpressure and at least one actuator to press the female mould 200 and the male mould 100 against each other can be arranged at the bottom 140, 240 of the base structure 110, 210. For instance a heated metal plate can be used to transfer heat to the flat bottom 140, 240.

Figure 10:
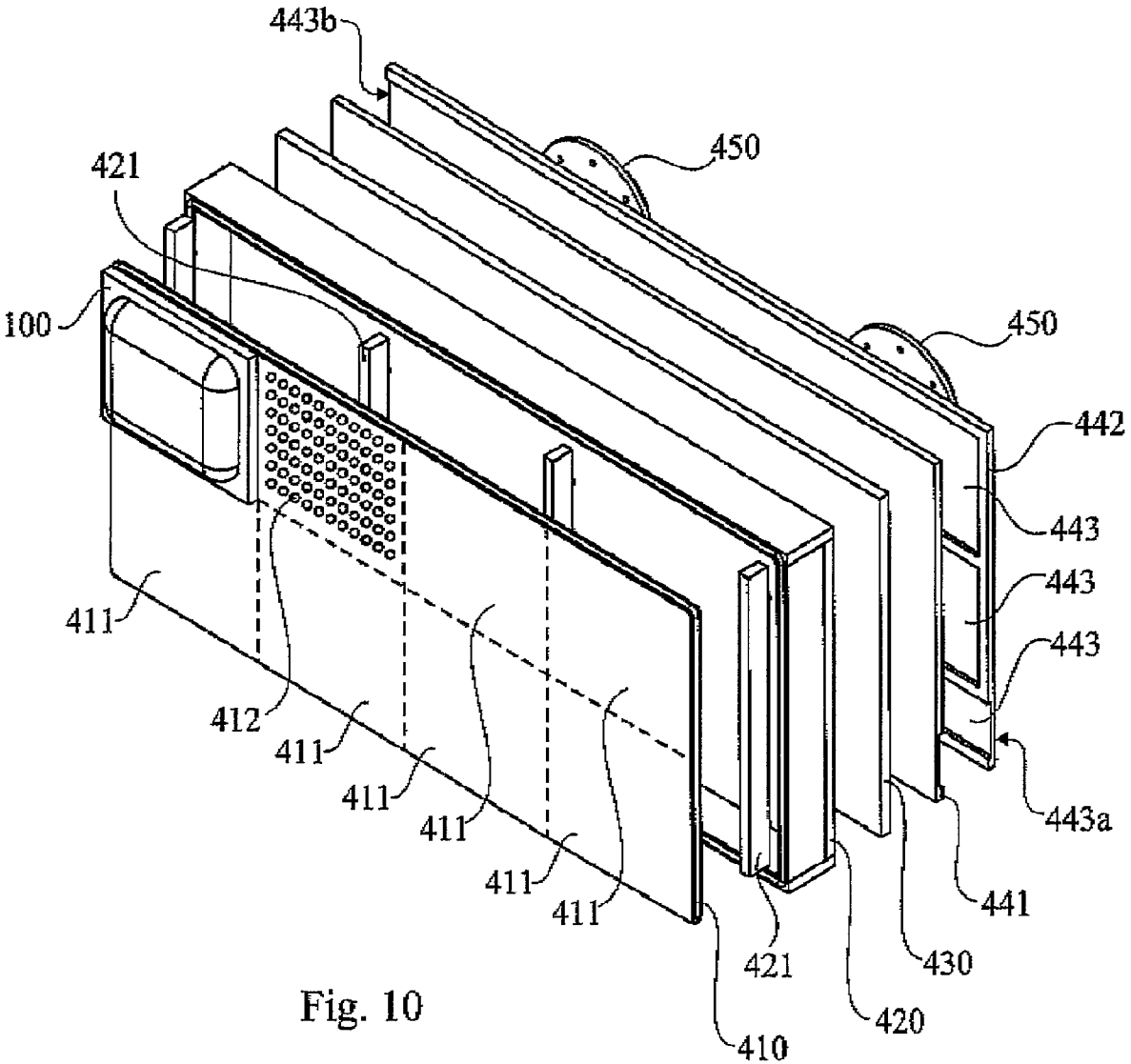
FIG. 10 is an exploded view of a preferred embodiment of a mould combined with a heat and vacuum suction tool according to the invention.

FIG. 10 is an exploded view of the heat and vacuum suction tool 400 of a preferred embodiment. A plurality of male pulp moulds 100 are arranged upon a support and heat plate 410. Of course the same heat and vacuum suction tool 400 can be used to attach female pulp moulds 200. The support and heat plate 410 is heated by means of induction. The support and heat plate 410 is divided into a plurality of locations 411, where in the preferred embodiment up to eight pulp moulds 100, 200 can be placed side by side. Of course the invention is by no means limited to this number, but it is rather depending outside production factors outside the scope of the present invention, i.e. the surface area of the support and heat plate 410 can be increased or decreased and/or the bottom area of the pulp mould 100, could likewise be increased or decreased. The support and heat plate 410 comprises a plurality of suction openings 412 which are connected to the vacuum chamber 420. Each male pulp mould 100 have its bottom side 140 being substantially flat, as mentioned below this may be achieved by machining. A machining action of a sintered porous surface will make the pore openings to clog. Thanks to the drainage channels 150 that will have no negative effect on the process, since sufficient throughput surface is achieved by the drainage openings despite the clogging of the pores at the bottom 140 of the pulp moulds 100. On the contrary it will be shown that this is rather an advantage in the present invention. The support and heat plate 410 comprises a plurality of suction openings 412 and these are preferably arranged to mate the openings $Ø_1$ of the plurality of drainage channels 150 at the bottom of the pulp mould 100. Since the bottom area between the drainage channels 150 is meeting the solid part of the support and heat plate 410, no suction would have occurred through the pore openings 112 at the bottom surface 140 in this embodiment. The clogging of the pores 112 at the bottom surface 140 presents an advantage due to the fact that this area is in contact with the solid part of support and heat plate 410 and hence heat is better transferred to the clogged machined bottom surface 140 and thereby to the pulp mould 100. The same principles of above will naturally yield for a female mould 200 attached to the heat and vacuum suction tool 400. The vacuum chamber 420 is arranged at the bottom of the support and heat plate 410. A plurality of spatial elements 421 are arranged to support the heat plate 410 and prevent the support and heat plate 410 from bend deformations due to the negative pressure in the vacuum chamber 420. An isolation plate 430 is arranged to the bottom of the vacuum chamber 420. The task appointed for the isolations plate 430 is to prevent heat from the support and heat plate 410 to transfer further to the process equipment. The isolation plate is preferably made of a material with low heat conductivity. A cooling element 440 is constructed from a first 441 and second 442 cooling plate. In the bottom side of the first cooling plate 441 and the front side of the second cooling plate 442 there is formed a machined cooling channel 443 having channel openings 443*a*, 443*b*. A fluid can flow into the cooling channel 443 or out from the cooling channel 443 through the channel openings 443*a*, 443*b*. The cooling channel 443 is formed in a meandering pattern from the first channel opening 443*a* towards the second channel opening 443*b*. To the bottom of the cooling element 440 there is arranged a plurality of attach devices 450. These plurality of attach devices 450 are used for attaching the heat and vacuum suction tool 400 to a pressing tool (not shown in the drawing).

According to a preferred embodiment the pulp mould is produced in the following manner. For the sintering process a basic mould (not shown) is used as is known per se, e.g. made of synthetic graphite or stainless steel. The use of graphite provides a certain advantage in some cases, since it is extremely form stable in varying temperature ranges, i.e. heat expansion is very limited. On the other hand stainless steel may be preferred in other cases, i.e. depending on the configuration of the mould, since stainless steel has a heat expansion that is similar to the heat expansion of the sintered body (e.g. if mainly comprising bronze) such that during the cooling (after sintering) the sintered body and the basic mould contracts substantially equally. In the basic mould there is formed a moulding face that corresponds to the moulding surface 130, 230 and also non-forming surfaces 160, 260 of the pulp mould (that is to be produced), which moulding face may be produced in many different ways known in the art, e.g. by the use of conventional machining techniques. Since a very smooth surface of the pulp mould is desirable the finish of the surface of the moulding face should preferably be of high quality. However, the precision, i.e. exact measurement, must not be extremely high, since an advantage with the invention is that high quality moulded pulp products may be achieved even if moderate tolerances are used for the configuration of the pulp mould. As described above, the first heat pressing action (when producing a moulded pulp product according to the invention), creates a kind of impulse impact within the fibre material trapped in the void 300 between the two mould halves 100, 200, that forces the free liquid out of the web in a homogeneous manner, despite possible variations of web thickness, which as a result provides a substantially even moisture content within the whole web. Hence it is possible to produce the basic moulds with tolerances that allow cost efficient machining.

For the actual production of the pulp mould 100, 200 the whole portion of the formed surface of the basic mould is arranged with an even layer of the very fine particles, that will form the surface 130, 230; 160, 260 of the pulp mould, which is performed by providing a thin layer to the basic mould that will adhere the particles 131, 231 of the surface layer 130, 230; 160, 260. This may be achieved in many different ways, for instance by applying a thin sticky layer (e.g. wax, starch, etc.) on to the basic mould, e.g. by means of spray or by applying it with a cloth. Once the sticky layer has been applied an excessive amount of the fine particles 131, 231 (which form the surface layer of the pulp mould) are poured into the mould. By movement of the basic mould, such that the excessive amount of particles 131, 231 move around onto every part of the surface within the basic mould, it is accomplished to arrange an even layer of the fine particles 131, 231 on each part of the surface in the basic mould. This process may be repeated to achieve further layers, for instance the support layers 120, 220. In the next stage pointed elongated elements, e.g. nails, which preferably have a slightly conical shape, are arranged on top of the last layer. These objects will form enlarged drainage passages 150, 250 in the basic body, which will facilitate an efficient drainage of fluid from the pulp web and providing a flow resistance hindering fluid to pour back. Thereafter further particles 111, 211 are poured into the basic mould forming the basic body 110, 210 of the pulp mould, on the top of the surface layer 130, 230. Normally these further particles have a larger size than the particles in the surface layer. Preferably the bottom surface 140, 240 of the pulp mould, i.e. the surface that is now directed upwardly, is evened out, before the entire basic mould is introduced into the sintering furnace, wherein the sintering is accomplished in accordance with conventional know how. After cooling, the sintered body 100, 200 is thereafter taken out of the basic mould and the sharp pointed objects taken out from the body, which is especially easy if these are conical. (It may be preferred to apply the "nails" to a plate, which allows for introduction and removal of the "nails" in an efficient manner). Finally the rear surface of the pulp mould 140, 240 preferably is machined in order to obtain a totally flat supporting surface. The provision of a flat surface leads to advantages, since firstly it facilitate exact positioning of the mould half 100, 200 onto a supporting plate 410, secondly it provides for transmitting the applied pressure evenly through the whole mould 100, 200 and finally it provides a very good interface for transmitting heat, e.g. from the support plate 410. However, it is understood that there is no need to always use a totally flat surfaces, but that in many cases the substantially plane surface that is achieved directly after the sintering is sufficient.

Moreover, some parts 160, 260 of the surface 130,230; 160, 260 are not used to form a pulp object, but there are peripheral surfaces 160, 260 that will not be used to form a pulp object. As a consequence, these surfaces 160, 260 are given a permeability that is substantially smaller than the moulding surfaces 130, 230. As mentioned above, this may be achieved by applying a thin impermeable layer 161, 261 having appropriate properties, e.g. any kind of paint having sufficient strength durability to maintain its impermeable function when used under operating conditions.

The pulp moulds 100, 200 are operated by pressing the moulds 100, 200 together so that the moulding surfaces 130, 230 face each other. In the forming space 300 between the moulding surface 130, 230 a wet fibrous content is arranged on one of the moulding surfaces 130, 230, preferably by means of suction. The pulp moulds 100, 200 can be heated during the pressing operation and the resulting temperature at the moulding surfaces is preferably above 200° C., most preferred around 220° C. By pressing the pulp moulds 100, 200 quick with impulse pressing under high pressure and high temperature, large parts of the water in the fibrous content vaporises and the steam quickly expands and tries to escape the narrow area. The steam can evacuate the pulp moulds 100, 200 by means of the porosity of moulding surface 130, 230, the support structure 120, 220, the base structure 110, 210 and the plurality of drainage channels 130, 230.

Means of vacuum suction can further increase the evacuation speed and increase the amount of liquid and steam leaving the fibrous content. When the pulp moulds 100, 200 again are separated from each other, the moulded pulp object which has been created from the fibrous content, is held to one of the moulding surfaces 130, 230 preferably by means of suction. Possibly also a gentle blow is applied through the opposite surface 230, 130 at this moment to safeguard that the pulp object leaves with the desired mould half. When separating the pulp moulds 100, 200 a negative pressure can occur in the forming space 300, this negative pressure is far smaller than the pressing pressure. The conical endings of the plurality drainage channels 150, 250 together with the small openings $Ø_3$ as well as the difference between the pore sizes 132*d*, 232*d* in the moulding surface 130, 230, the pore sizes 122*d*, 222*d* of the support layer 120, 220 and the pore sizes 112*d*, 212*d* of the base structure 110, 210, functions as a flow resistance and restrain backflow to the forming space 300, thereby restraining backflow to the fibrous content.

The invention is not limited by what is described above but may be varied within the scope of the appended claims.

Of course the configurations of the female 200 and male 100 moulds can differ from each other. The sintered particles 131, 231 in the moulding surface 130, 230 may differ in sizes, i.e. 131*d* and 231*d* may have different values. Likewise the sintered particles 121, 221 in the support layer 120, 220 may differ in sizes, i.e. 121*d* and 221*d* may have different values. Similarly the sintered particles 111, 211 in the base structure 110, 210 may differ in sizes, i.e. 111*d* and 211*d* may have different values. The thickness 133, 233 of the moulding layer 130, 230 preferably lies within 0.01 mm-1 mm and it is evident for the skilled person that the thickness 133 and the thickness 233 may differ from each other. The thicknesses of the support layer 123, 223 may also differ from each other. It is also to be understood that in some embodiments the plurality of drainage channels 150, 250 may be used in only one of the moulds 100, 200 or in none of the moulds 100, 200. Also the spatial placement of the plurality of drainage channels 150, 250 may differ between the moulds 100, 200 as well as the size parameters $Ø_1$, $Ø_2$, $Ø_3$, t1, t2 and other shape characteristics of the plurality of drainage channels 150, 250. Obvious the distribution density of the plurality of drainage channels 150, 250 may also differ between the female 200 and the male 100 mould. Furthermore the skilled person realises that the plurality of drainage channels 150, 250 may differ in size and shape within an individual mould 100, 200. Furthermore the moulding surface 130, 230 may comprise particles of different materials, shapes and sizes and may be divided into different segments, each segment comprising a certain particle type. Likewise the support layer 120, 220 may comprise particles of different materials, shapes and sizes and may comprise different substantial layers, e.g. each substantial layer comprising a certain particle type. For instance the support layer 120, 220 may comprise several layers where the size of the sintered particles 121, 221 gradually is increased whit the smallest particles adjacent to the moulding surface 120, 220 and the largest particles adjacent to the base structure 110, 210. Similar the base structure 110, 210 may comprise particles of different materials, shapes and sizes and may be divided into different substantial layers comprising, e.g. each substantial layer comprising a certain particle type. The shape of the sintered particles of the base structure 110, 210, the support layer 120, 220 and the moulding surface 130, 230 may for example be spherical, irregular, short fibres or of other shapes. The material of the sintered particles may for example be bronze, nickel based alloys, titanium, copper based alloys, stainless steel etc. Furthermore it is to be understood that the shape of the mould 100, 200 is decided by the wanted shape of the fibrous object and that the shape of the embodiments are by means of example. Since the pulp moulds 100, 200 are produced using a sintering technique very complex shapes can be formed. For example a graphite form or a stainless steel form can be used for the sintering process and such a graphite form or stainless steel form can easily be manufactured in a workshop in complex shapes and with high accuracy. This makes it easy and cost effective to test alternative shapes for the fibrous object. Furthermore low production series of fibrous objects can be commercial possible due to the relative low cost of manufacturing a pulp mould 100, 200 of the present invention. It is further to be understood that both pulp moulds 100, 200 can be heated during operation as well as only one of the pulp moulds 100, 200 as well as none of the pulp moulds 100, 200. The pulp moulds 100, 200 can be heated in a wide variety of ways, a heated metal plate 410 can be attached to the bottom 140, 240 of the pulp moulds 100, 200, hot air can be blown at the pulp mould 100, 200, heating elements can be added inside the base structure 110, 210, a gas flame can heat the pulp mould 100, 200, inductive heat may be applied, microwaves may be used, etc. Furthermore a vacuum source can be applied to the bottom 140, 240 of both pulp moulds 100, 200, as well as to the bottom 140, 240 of only one of the pulp moulds 100, 200, as well as to none of the pulp moulds 100, 200. Moreover the source of pressing the pulp mould 100, 200 together can be imposed on both pulp moulds 100, 200 or to only one of the pulp moulds 100, 200 fixating the other pulp mould 200, 100. Furthermore merely one of the pulp moulds 100, 200 could be used as a stand alone forming tool, to form a wet fibrous object in a conventional manner, i.e. normally by means of suction and thereafter normally dried in an oven, i.e. without any pressing steps. Furthermore the skilled man realises that the voids 114, 214, 124, 224 can be filled with particles of appropriate sizes depending of the manufacturing technique used in creating the sintered pulp mould 100, 200. Moreover in some situations there might not be necessary to have an outermost layer having such small particles as the moulding surface 130, 230 of the invention. It is to be understood that the pulp mould of the invention can be used without the moulding layer, i.e. the support layer 120, 220 on top of the base structure 110, 210, as well as only the base structure 110, 210 as the outermost layer. For instance in the forming step of the pulp moulding process, the pulp mould 100, 200 may have larger particles in the outermost layer than in forthcoming pressing steps. Depending of an actual embodiment of the invention the drainage channels 150, 250 could have its pointed opening $Ø_3$ anywhere in the interval from the border between the base structure 110, 210 and the support layer 120, 220 till the border between the moulding surface 130, 230 and the forming space 300. Moreover, using the support and heat plate 410 beneath the pulp mould 100, 200 where the suction openings 412 are arranged to mate the bottom openings $Ø_1$ of the plurality of drainage channels 150, 250, it is obvious that it is preferred that the mating is a close match as possible and preferably every suction opening 412 always mate a corresponding bottom opening $Ø_1$, but of course the invention is not limited to a perfect match rather the suction openings 412 could differ in diameters contra the bottom openings $Ø_1$ and the number of suction openings 412 could be larger as well as smaller than the corresponding bottom openings $Ø_1$. Since the pulp mould 100, 200 preferably are constructed by metal particles and since the pulp mould does not have a relief shape, i.e. the thickness of the pulp mould 100, 200 is not constant following the contour of the pulp moulded object, but has preferably a flat bottom 140 resulting in that the thickness of the pulp mould 100, 200 varies depending of the shape of the pulp moulded object, the pulp mould is able to withstand very high pressure without deforming or collapsing compared to a pulp 100, 200 mould having a relief shape and/or comprised by a material of less strength, for instance glass beads.

The invention claimed is:

1. A pulp mold for molding of objects from fibre pulp, comprising:

a molding surface comprising first sintered particles;

a permeable base structure, wherein the permeable base structure comprises second particles having an average diameter that is larger than an average diameter of the first sintered particles of the molding surface; and a permeable support layer comprising third particles arranged between the permeable base structure and the molding surface, wherein the third particles of the permeable support layer have an average diameter less than the average diameter of the second particles of the permeable base structure.

2. The pulp mold of claim 1, wherein the second particles of the permeable base structure are sintered.

3. The pulp mold of claim 1, wherein the third particles of the permeable support layer are sintered.

4. The pulp mold of claim 1, wherein the average diameter of the third particles of the permeable support layer is greater than the average diameter of the first sintered particles of the molding surface.

5. The pulp mold of claim 1, wherein the average diameter of the first sintered particles of the molding surface is within the range 0.01-0.19 mm.

6. The pulp mold of claim 1, wherein the average diameter of the first sintered particles of the molding surface is within the range of 0.05-0.18 mm.

7. The pulp mold of claim 1, wherein the average diameter of the second sintered particles of the permeable base structure is within the range of 0.25-10.0 mm.

8. The pulp mold of claim 1, wherein the average diameter of the second sintered particles of the permeable base structure is within the range of 0.35-5.0 mm.

9. The pulp mold of claim 1, wherein the average diameter of the second sintered particles of the permeable base structure is within the range of 0.45-2.0 mm.

10. The pulp mold of claim 1, wherein the pulp mold comprises at least one drainage channel.

11. The pulp mold of claim 10, wherein the drainage channel comprises a first tapered section comprising a first average diameter in the permeable base structure and a second tapered section comprising a second average diameter in the molding surface wherein the second diameter is smaller than the first diameter.

12. The pulp mold of claim 11, wherein the first average diameter is at least 1 mm and the second average diameter is less than 500 micrometers.

13. The pulp mold of claim 11, wherein the first average diameter is at least 1 mm and the second average diameter is less than 50 micrometers.

14. The pulp mold of claim 11, wherein the first average diameter is at least 1 mm and the second average diameter is less than 25 micrometers.

15. The pulp mold of claim 1, wherein the pulp mold comprises a plurality of drainage channels.

16. The pulp mold of claim 15, wherein the plurality of drainage channels each comprise a first end and a second end, wherein the first end of each of the plurality of drainage channels terminates within the permeable base structure and the second end terminates within the molding surface.

17. The pulp mold of claim 15, wherein the plurality of drainage channels each comprise a second end which terminates within the permeable support layer.

18. The pulp mold of claim 15, wherein the plurality of drainage channels each comprise a first end which terminates proximate to the molding surface.

* * * * *